US012674321B2

(12) United States Patent
Patel

(10) Patent No.: US 12,674,321 B2
(45) Date of Patent: Jul. 7, 2026

(54) ANCHOR FOR POST TENSIONED CONCRETE REINFORCEMENT

(71) Applicant: POST TENSION SERVICES GUJARAT LLP "PTSI", Vadodara (IN)

(72) Inventor: Urav Patel, Vadodara (IN)

(73) Assignee: POST TENSION SERVICES GUJARAT LLP "PTSI", Vadodara (IN)

( * ) Notice: Subject to any disclaimer, the term of this patent is extended or adjusted under 35 U.S.C. 154(b) by 177 days.

(21) Appl. No.: 18/579,105

(22) PCT Filed: Sep. 29, 2023

(86) PCT No.: PCT/IN2023/050897
§ 371 (c)(1),
(2) Date: Jan. 12, 2024

(87) PCT Pub. No.: WO2025/027618
PCT Pub. Date: Feb. 6, 2025

(65) Prior Publication Data

US 2025/0084640 A1 Mar. 13, 2025

(30) Foreign Application Priority Data

Jul. 29, 2023 (IN) ..... 202321051136

(51) Int. Cl.
*E04C 5/12* (2006.01)
*E04C 5/16* (2006.01)

(52) U.S. Cl.
CPC ..... *E04C 5/122* (2013.01); *E04C 5/165* (2013.01)

(58) Field of Classification Search
CPC ..... E04C 5/122; E04C 5/165
(Continued)

(56) References Cited

U.S. PATENT DOCUMENTS 2,921,462 A * 1/1960 Wilson ..... E04B 2/30 52/378
3,307,310 A * 3/1967 Kourkene ..... E04C 5/12 52/223.13

(Continued)

FOREIGN PATENT DOCUMENTS

KR 100830630 B1 * 5/2008 ..... E04C 5/08
KR 100858397 B1 * 9/2008 ..... E04C 3/26

*Primary Examiner* — Brian D Mattei
*Assistant Examiner* — Joseph J. Sadlon
(74) *Attorney, Agent, or Firm* — Kevin J Fournier IP Legal Services Ltd; Kevin J Fournier

(57) ABSTRACT

The present invention relates to an anchor (10) for post tensioned concrete reinforcement comprising a base member (14), a rear tubular portion (22), a front tubular portion (24), reinforcing ribs (42), and four mounting holes (56). The square plate shaped base member (14) facilitates uniform distribution of load on the concrete surface. The base member (14) has rounded corners to minimize stress concentration. The rear tubular portion (22) and front tubular portion (24) protrude from the base member (14) in opposite directions forming a through tubular section (30). The rear tubular portion (22) receives the tendon (34) to extend into the inner cavity of the tubular section (30). The front tubular portion (24) has a tapered inner cavity that receives a conventional tapered wedge (32). The tapered wedge (32) is tightened, which forces it against the sides of the tapered inner cavity, clamping the tendon in place. The reinforcing ribs (42) extend radially outward from the exterior of the front tubular section (24) on the front surface (16) of the base member (14). The anchor (10) is light weight, cost effective and easy to manufacture and handle on account of increased strength and less material requirement. The mounting holes (56) allow the anchor (10) to be secured to the concrete surface with nails (58). This arrangement
(Continued)

allows the anchor (10) to be oriented in any direction, which provides flexibility in installation.

6 Claims, 11 Drawing Sheets

(58) Field of Classification Search
USPC ..... 52/223.13
See application file for complete search history.

(56) References Cited

U.S. PATENT DOCUMENTS 3,552,787 A * 1/1971 Yee ..... E04C 5/165 52/432
3,590,474 A * 7/1971 Beghi ..... E04C 5/125 29/520
3,676,031 A * 7/1972 Stinton et al. ..... E04C 5/12 249/43
4,094,110 A * 6/1978 Dickens ..... E04B 1/3505 52/444
4,486,991 A * 12/1984 Rahlwes ..... E04C 5/125 52/223.13
4,791,772 A * 12/1988 Potucek ..... E04C 5/165 52/852
4,918,887 A * 4/1990 Davis ..... E04C 5/122 52/223.13
4,976,078 A * 12/1990 Jartoux ..... E04C 5/122 52/223.13
5,024,032 A 6/1991 Rodriguez
5,440,842 A * 8/1995 Sorkin ..... E04C 5/12 52/223.13
5,778,622 A * 7/1998 Baker ..... E04C 1/395 428/903.3
6,581,343 B1 * 6/2003 Metelli ..... E04B 7/022 52/583.1
8,146,306 B2 4/2012 Hayes et al.
8,327,599 B2 * 12/2012 Gavin ..... E04C 5/203 52/680
9,097,014 B1 * 8/2015 Sorkin ..... E04C 5/122
9,874,016 B2 * 1/2018 Sorkin ..... E04C 5/122
9,890,545 B1 * 2/2018 Bongiorno ..... E04C 5/0618
9,989,082 B2 * 6/2018 Rodenhouse ..... F16B 43/001
10,077,554 B2 * 9/2018 Whitmore ..... H01B 13/221
10,626,613 B2 * 4/2020 Dos Santos ..... E04C 5/125
10,968,645 B2 * 4/2021 Kelly ..... E04G 21/142
11,174,614 B2 * 11/2021 Flint ..... E02D 29/05
11,174,651 B1 * 11/2021 Fischer ..... E04C 5/125
11,486,143 B2 * 11/2022 Sorkin ..... E04C 5/12
11,655,605 B2 * 5/2023 Zong ..... E02D 5/526 405/251
11,680,407 B2 * 6/2023 Langston ..... F16B 7/182 52/223.13
12,398,562 B2 * 8/2025 Hayek ..... E04C 5/122
2005/0210782 A1 * 9/2005 Kadotani ..... E04C 5/122 52/223.13
2006/0096197 A1 * 5/2006 Tollefson ..... E04B 5/48 52/223.13
2006/0179742 A1 * 8/2006 Mathews ..... E04C 5/122 52/223.13
2007/0107339 A1 * 5/2007 Matsumoto ..... E02D 27/32 52/295
2010/0322717 A1 * 12/2010 Paul ..... E02D 5/105 405/250
2018/0313086 A1 * 11/2018 Mathews ..... E04C 5/122
2021/0164186 A1 * 6/2021 Ang ..... E04C 5/12
2025/0290336 A1 * 9/2025 Fugallo, III ..... G06Q 50/08

* cited by examiner

SECTION 4-4

ANCHOR FOR POST TENSIONED CONCRETE REINFORCEMENT

CROSS-REFERENCE TO RELATED APPLICATIONS

This application is a national stage of International Application No. PCT/IN2023/050897, filed Sep. 29, 2023, which claims the benefit of Indian Application No. 202321051136, filed Jul. 29, 2023, in the Indian Patent Office, the disclosures of which are incorporated herein by reference.

FIELD OF THE INVENTION

The present invention relates to anchoring devices specially adapted for Post Tension concrete reinforcing. More specifically the present invention relates to aforementioned class of anchors wherein the tensile members are reinforced by wedge action.

BACKGROUND OF THE INVENTION

Many structures are built using concrete, including, for instance, buildings, industrial buildings, foundations, sports courts, parking structures, apartments, condominiums, hotels, malls, bridges, pavement, tanks, reservoirs, silos, mixed-use structures, medical buildings, government buildings, casinos, hospitals, research/academic institutions, and other structures.

Concrete is capable of withstanding significant compressive loads, however, it is not as capable of withstanding significant tensile loads. Thus, it is often necessary to reinforce concrete structures with steel bars, cables, or the like to enhance the structure's ability to withstand tensile forces.

Pre-stressed concrete is structural concrete in which internal stresses are introduced to the concrete member to reduce potential tensile stresses in the concrete resulting from applied loads; pre-stressing may be accomplished by post-tensioned pre-stressing or pre-tensioned pre-stressing. In a post tensioned reinforcement system, several Steel cables (called "strand or tendons") are placed within the concrete framing structure where the concrete will later be poured around them. At this point, each tendon is held loosely in place, and the ends of each tendon pass through an anchor on each side of the concrete slab that composes a portion of the total concrete structure. The post-tensioning tendon includes an anchor at each end. The tension member is fixedly coupled to a fixed anchor positioned at one end of the tension member, the so-called "fixed-end" of the tension member, and is adapted to be stressed at the stressing anchor, the "stressing-end" of the tensioning tendon.

Once the concrete is poured and has cured for a sufficient amount of time, but not yet to the point of being fully cured, the tendons may be tensioned by a hydraulic tensioner. The hydraulic jack tensioners that may be used in these circumstances are driven by high pressure hydraulic fluid pump in one or more cylinders in the tensioner that places the tendon under a high tensile load, for example 30,000-40,000 pounds force.

A concrete anchor is typically formed as a singular body by casting and includes a body portion that has a one bearing plate portion, and two generally cylindrical shaped barrel portion, one extending from the front surface of the bearing plate and another extending from the rear surface of the bearing plate. To help support the force that will be applied to the tendon after tensioning, the anchor also includes several ribs located on the front surface of the bearing plate. The rear surface of the bearing plate is used to contact the concrete and provide a load bearing surface during the tensioning of the tendon by the hydraulic jack tensioner. The bearing plate portion of the anchor is typically of a constant thickness and includes two or more mounting holes so the anchor can be fastened to the concrete structure, which is often completed with nails or similar fasteners.

The anchors in the prior art also include a barrel portion has an upper annular wall extending from the upper Surface of the bearing plate and a lower annular wall depending from the lower Surface of the bearing plate. The inner Surfaces of the upper annular wall and lower annular wall together define an internal wedge-receiving cavity passing through the bearing plate and having a central axis substantially perpendicular to the bearing plate. The wedge-receiving cavity has a specific angle of taper with respect to the central axis. The cavity has a diameter at the lower end that is at least as great as the diameter of the sheathing on the tendon to be anchored. The cavity has an overall height that is at least as great as the height of the wedges to be used. The outer surface of the upper annular wall is upwardly tapered. The outer surface of the lower annular wall is downwardly tapered. A plurality of ribs extend from the outside of the upper annular wall to the upper surface of the bearing plate. The sheathed portion of the tendon may freely pass through the wedge-receiving cavity of the anchor.

Before the concrete is poured around the tendons, each tendon must pass through an anchor that will be located on each side of where the concrete slab will eventually be located. The tendon enters the anchor by entering the bore in the lower annular wall of barrel portion on the rear surface of the bearing plate and exiting the bore in the upper annular wall of barrel portion on the front surface of the bearing plate. After the tendon exits the anchor, the wedge may be placed around the tendon in the frusto-conical bore of the anchor.

To allow access to the stressing end of the post tensioning tendon once the concrete is poured, a pocket former may be utilized to prevent concrete from filling the area between the stressing anchor and the concrete form used to form the concrete member. Once the concrete has sufficiently hardened and the concrete side formwork is removed, the pocket former is removed from the concrete member. Traditionally, pocket formers are tapered to, for example, allow for easier removal from the concrete member. Typically, once the post-tensioned tendon is stressed, thereby forming a post-tensioned concrete member, and the pocket former removed, the pocket formed by the pocket former is filled with a material such as a cementitious chloride-free grout or concrete to, for example, provide fire protection and corrosion protection.

After the concrete is poured and allowed to partially cure for a sufficient amount of time, the tendon may be tensioned by a hydraulic jack tensioner. After the tendon is tensioned by the hydraulic jack tensioner, the tendon and wedge are forced tightly into the bore. The wedge is shaped such that it has teeth that help locking the tendon in place during tensioning. The tensioning force on the tendon passes to the wedge and to the upper annular wall, lower annular wall, and bearing plate portions of the anchor, and ultimately to the concrete slab. The ribs help distribute that force throughout the body of the anchor and onto the rear Surface of the bearing plate portion of the anchor, thus providing the tensile strength to the concrete structure.

Many prior arts have tried to work on the same field. Some the most relevant ones among them being reproduced here briefly.

U.S. Pat. No. 5,024,032 relates to post-tensioning Anchor having Rectangular Bearing plate with 4 ribs. As shown in this prior art the Post-tensioning Anchor of the type constructed for securement to a concrete structure and the receipt of a tensioning cable therethrough. There is shown the front face of the anchor is constructed with series of gussets (in our invention name as Ribs) tapering downwardly from central cylindrical body section. Problem often arise with said prior art, when a series of, numbers of Anchor required to accommodate in specific area of slab or beam because of rectangular bearing plate. However said prior art is having two holes generally located in single line and problem often arise to accommodate or to have more choices and flexibility to affix the anchor to a concrete form and/or to mount accessories such as plastic encapsulating elements.

U.S. Pat. No. 8,146,306 relates an Anchor for post-tension reinforcement. The anchor includes and rectangular anchor base having 4 ribs and having at least one wedge receiving bore therein. Also shown an embodiment of an anchor having four mounting holes in the metal structure. Problems often arise with said prior art, when a series of, numbers of Anchor required to accommodate in specific area of slab or beam because of rectangular bearing plate. However said prior art is having four holes in single line only and problem often arise to accommodate or to have more choices and flexibility to use all four holes to affix the anchor to a concrete form and/or to mount accessories such as plastic encapsulating elements, as it is having four holes in one line only.

Many anchors are used in post-tensioned concrete construction and so it is important that they be efficient in performing their function. Excess material in an anchor leads to increased weight that is unnecessary for the proper functioning of the anchor and results in a waste of raw materials used to compose the concrete anchor, as well as increased shipping costs of the anchor.

It is desirable to provide an improved anchor for a post-tension anchoring system which allows for the use of standard wedges in the wedge cavity and which can be used at the stressing (live) end, fixed (dead) end as well as being used as an intermediate anchor. It is further desirable that the anchor can be used as an intermediate anchor with a sheathed tendon and any anchor location where is desirable for the sheathing to pass through the anchor. It is also desirable that the anchor meets certification and testing requirements. It is also desirable that the anchor to reduce weight while maintaining structural integrity. Additionally, it is desirable that the anchor is cost effective, reliable and easy to manufacture and use.

The prior art documents have several disadvantages. For example, prior art anchors often have a rectangular bearing plate with two or four mounting holes. This can make it difficult to accommodate multiple anchors in a small area. Additionally, prior art anchors often have a single line of mounting holes, which can limit the flexibility in how the anchor is attached to the concrete structure. They fail to offer spatial flexibility. The prior art anchors are essentially end tensioning anchors and lack the flexibility to be deployed.

It is desirable to provide an improved post tensioning anchor that overcomes aforementioned drawbacks and is specifically suitable for mono strand un-bonded tendon, since mono strand tendons in themselves are a wide field and have wide application in the field of post tensioning with challenges and functionalities unique to mono strand tendons.

OBJECTS OF THE INVENTION

The primary object of the present invention is to provide an anchor for post tensioned concrete reinforcement that is light weight, requires less material while maintaining structural integrity and consequently less costly as compared to the conventional anchors. Another object of the present invention is to provide an anchor for post tensioned concrete reinforcement that is easier to install, offers spatial flexibility in terms of orientation and consumes less space as compared to the conventional anchors.

Another object of the present invention is to provide an anchor for post tensioned concrete reinforcement that achieves the afore mentioned objective while being employed for mono strand tendons.

Another object of the present invention is to provide an anchor for post tensioned concrete reinforcement with increased the ease of packaging, storage and handling, thus contributing to further reduction of shipment and material handling cost.

Another object of the present invention is to provide an anchor for post tensioned concrete reinforcement that is protected from atmospheric corrosion.

Another object of the present invention is to provide an anchor for post tensioned concrete reinforcement that offers flexibility to be deployed as intermediate anchor as well.

Other object of the present invention is to provide an anchor for post tensioned concrete reinforcement are apparent from the advantage stemming out of the foregoing constructional details in this complete specification.

SUMMARY OF THE INVENTION

The present invention provides an anchor for post tensioned concrete reinforcement that addresses the drawbacks of conventional anchors. The anchor of the present invention is lightweight and compact, making it easier to install. And, said Encapsulated Anchor is encapsulated to provide corrosion-resistance and thereby, increases the durability.

The anchor of the present invention comprises a base member, a rear tubular portion, a front tubular portion, reinforcing ribs, and four mounting holes. The base member is shaped substantially as a square plate and has a thickness that facilitates uniform distribution of load on the concrete surface. The base member is chamfered at the corners to rounded shape to minimize stress concentration.

The rear tubular portion and front tubular portion protrude from the base member in opposite directions. The rear tubular portion has an opening that allows the tendon to extend into the inner cavity of the tubular section. The front tubular portion has a tapered inner cavity that receives a conventional tapered wedge. The tapered wedge is tightened, which forces it against the sides of the tapered inner cavity, clamping the tendon in place.

The reinforcing ribs extend radially outward from the exterior of the tubular section on the front surface of the base member. The reinforcing ribs help to distribute the load uniformly in all directions on the concrete surface.

The four mounting holes are located near the corners of the base member. The mounting holes allow the anchor to be secured to the concrete surface with nails. The nails are inserted through the mounting holes and perpendicular to the front and rear surfaces of the base member. This arrangement allows the anchor to be oriented in any direction, which provides flexibility in installation.

DETAILED DESCRIPTION OF THE INVENTION

The following is a more detailed description of the anchor of the present invention being described in conjunction with the drawings for a better understanding.

To better understand the anchor for post tensioned concrete reinforcement according to the invention, it is useful to examine specific difference between various embodiments of an anchor according to the invention and prior art post tension anchors.

Figure 1:
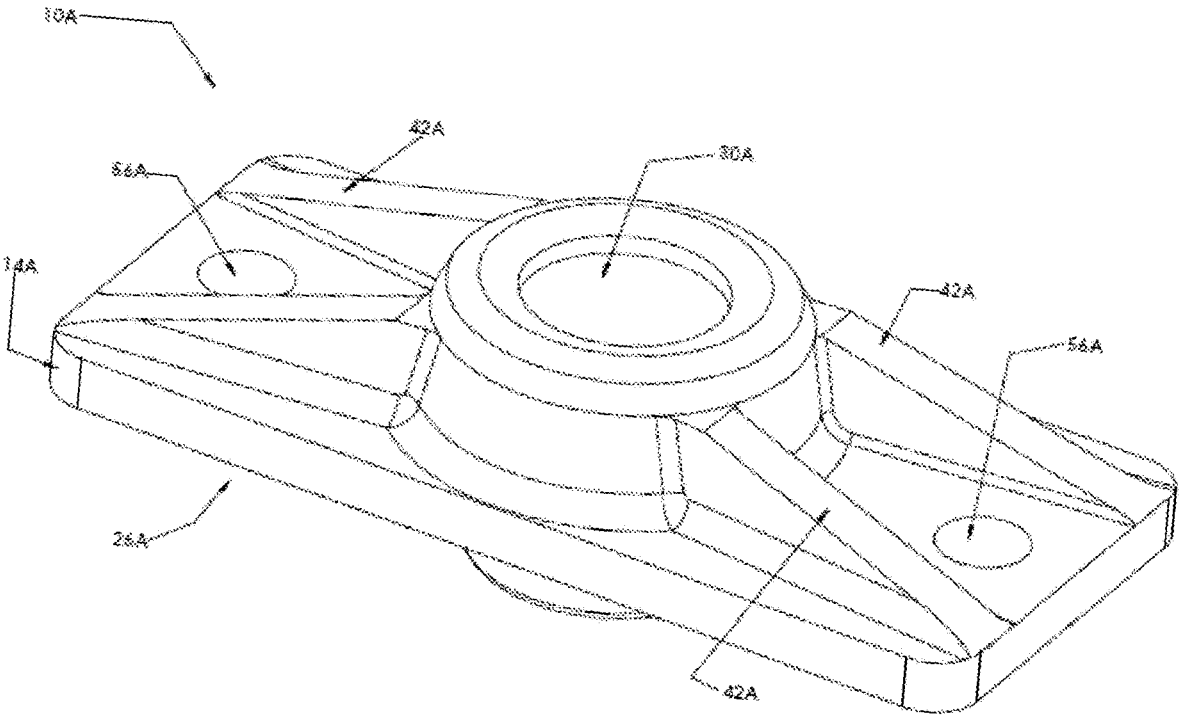
FIG. 1 PRIOR ART
FIG. 1 is a perceptive view of a prior art post tension anchor.
Figure 2:
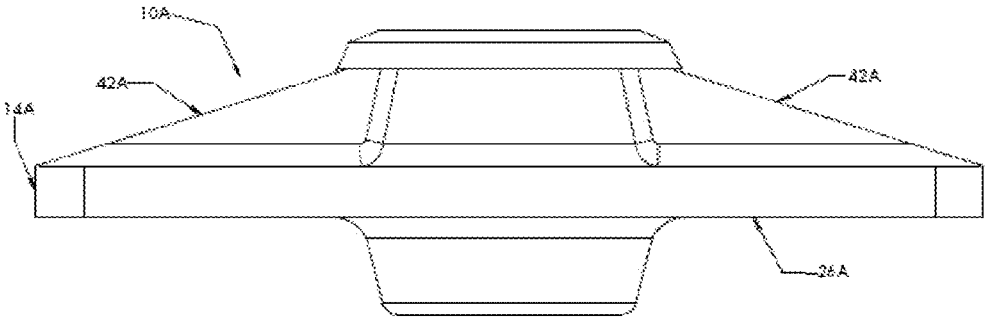
FIG. 2 PRIOR ART
FIG. 2 is a side view of the anchor of FIG. 1.
Figure 3:
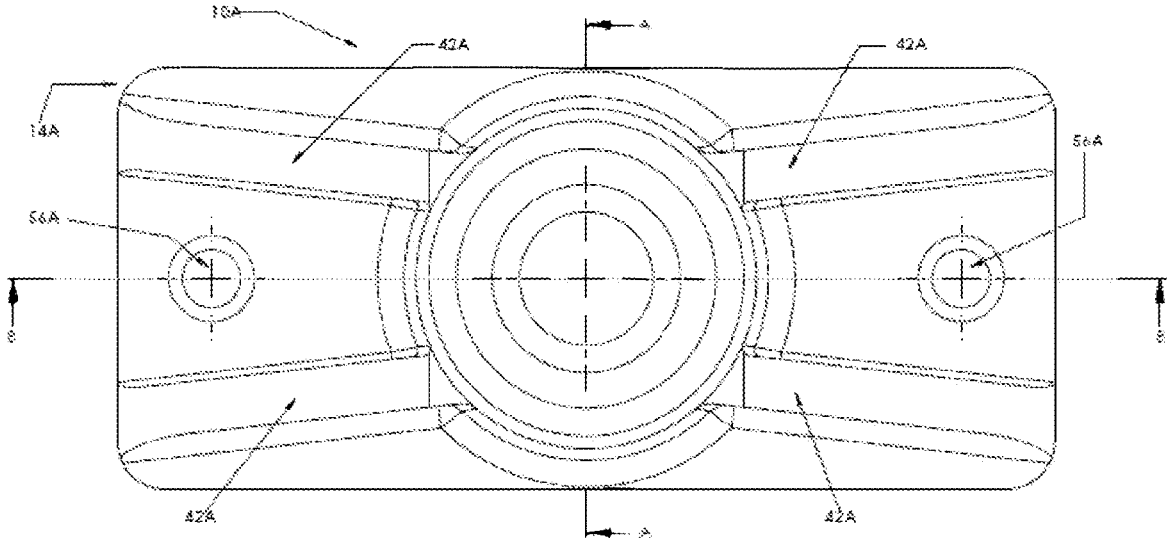
FIG. 3 PRIOR ART
FIG. 3 is a top view of the anchor of FIG. 1.
Figure 4:
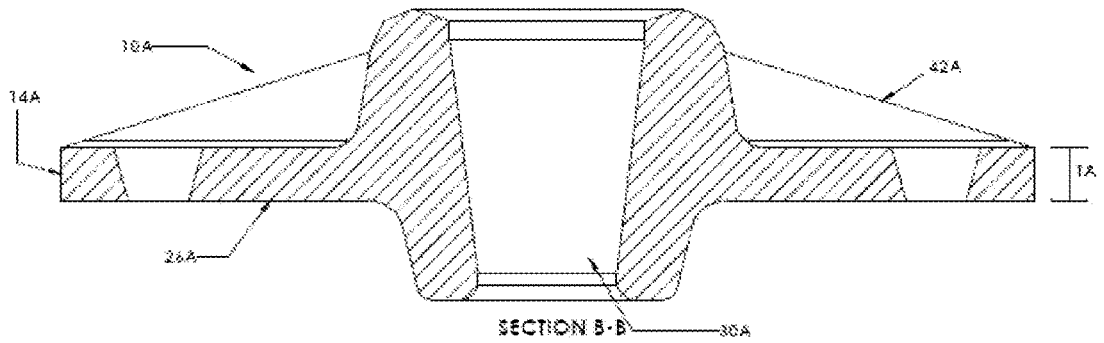
FIG. 4 PRIOR ART
FIG. 4 is a cross-section of the anchor of FIG. 1.
Figure 5:
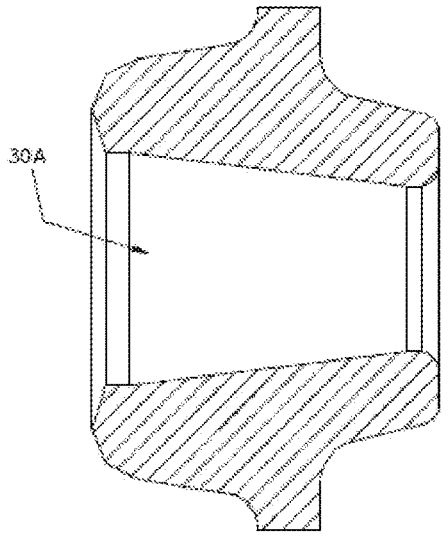
FIG. 5 PRIOR ART
FIG. 5 is a cross-section orthogonal to the cross section of FIG. 4

A typical prior art post-tension anchor shown in FIG. 1. The anchor 10A includes an anchor body typically cast from ductile iron or similar cast iron metals. The Anchor 10A includes a cast metal structure 14A having a Rectangular load-bearing basal surface 26A. The load-bearing basal surface 26A is adapted to contact a concrete structure (not shown) for post tension reinforcement according to methods well known in the art. The basal surface 26A is where tension from the tendon (not shown) is actually transferred to the concrete structure (not shown). The anchor 10A also includes a plurality of reinforcing ribs (total 04 ribs) 42A which extend substantially from the outer edges of the anchor body to a generally central portion of the anchor body structure which defines a wedges receiving bore (shown at 30A in FIGS. 4 & 5). As shown in the FIG. 3 the anchor 10A also includes two accessory/mounting holes 56A. Referring to FIG. 5 the typical thickness indicated by "TA" of the metal structure 14A (forming the load bearing basal surface 26A) is about 0.23 inches (5.84 mm).

Figure 6:
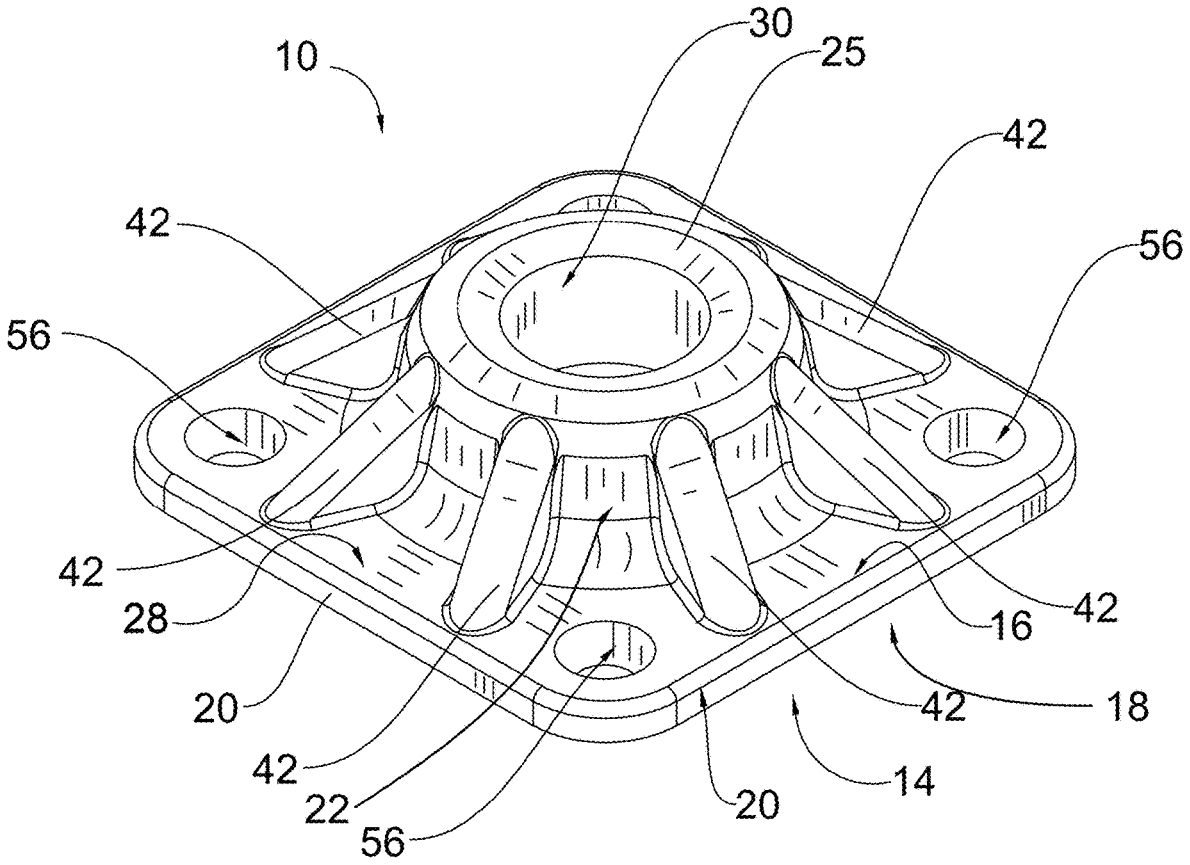
FIG. 6 is a perspective view of an anchor for post tensioned concrete reinforcement embodying the present invention.
Figure 8:
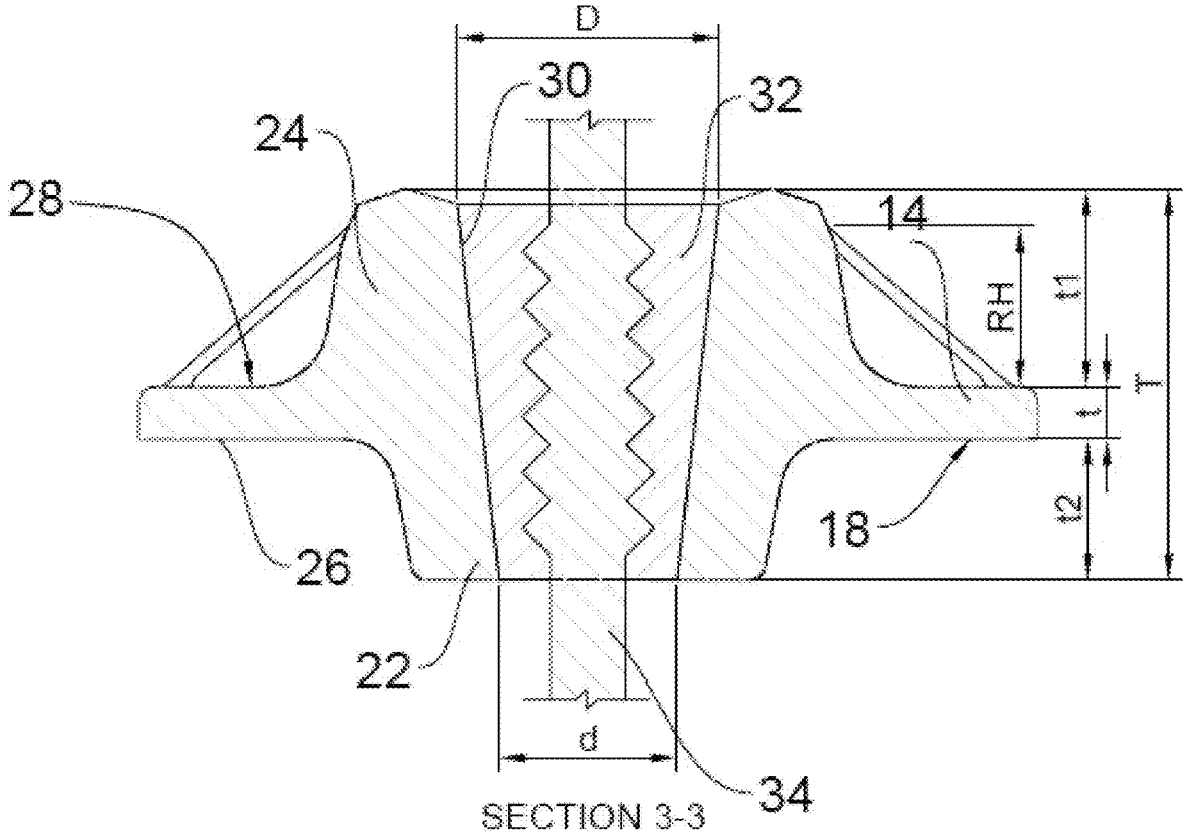
FIG. 8 is a cross-sectional view along line 3-3 showing an anchor for post tensioned concrete reinforcement embodying the invention and further showing a wedge, a tendon, and nails.
Figure 9:
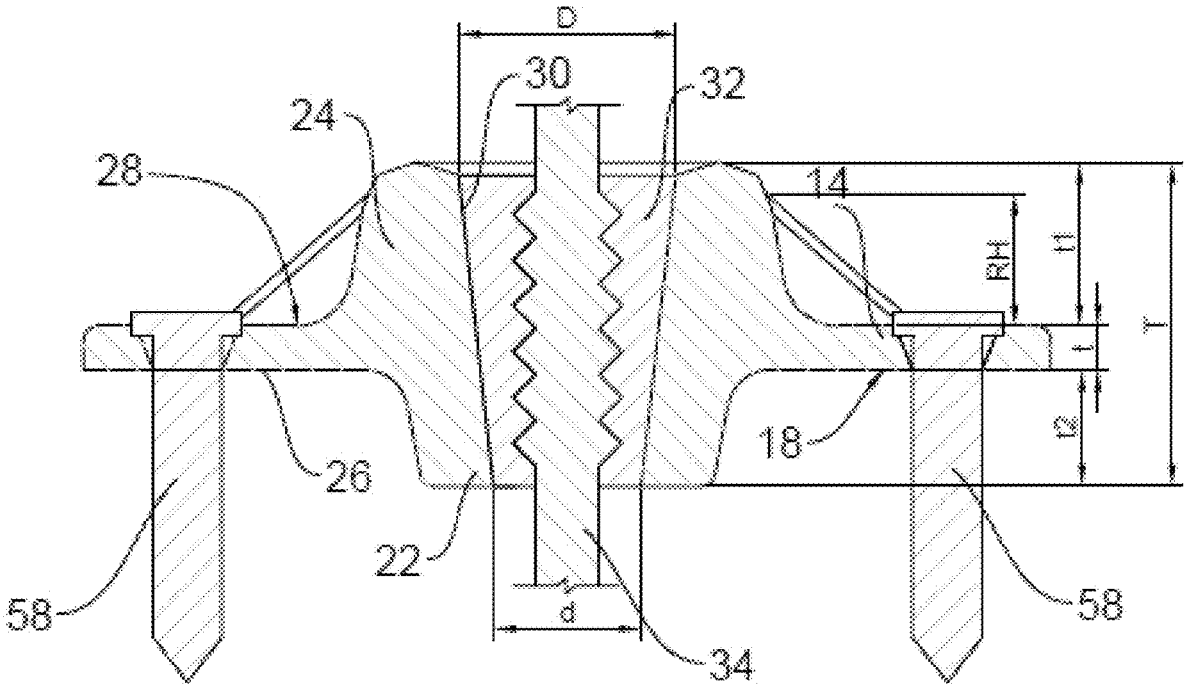
FIG. 9 is a cross-sectional view along line 4-4 showing an anchor for post tensioned concrete reinforcement embodying the invention and further showing a wedge, a tendon, and nails.
Figure 10:
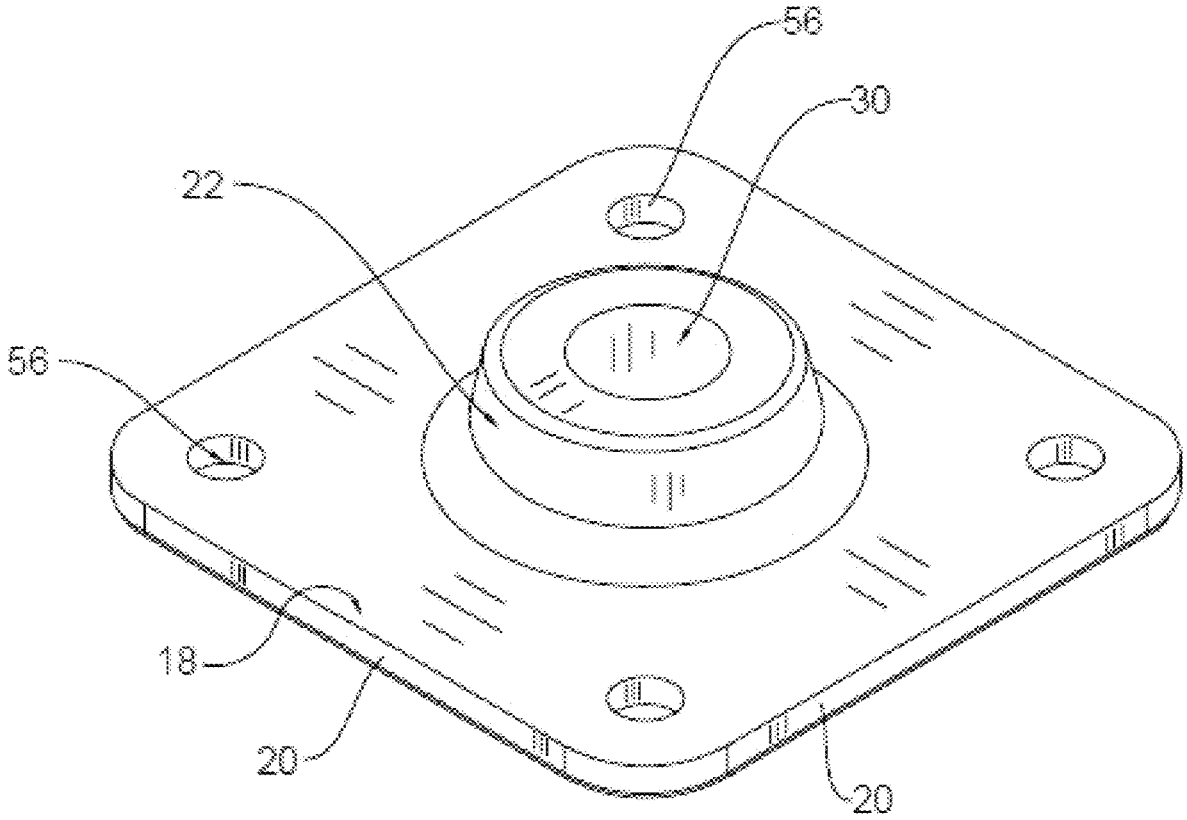
FIG. 10 is a bottom elevation view of an anchor for post tensioned concrete reinforcement embodying the invention.

Referring to FIG. 6, an anchor for post tensioned concrete reinforcement (10) embodying the present invention is illustrated. The anchor for post tensioned concrete reinforcement (10) has a base member (14) that has both a front (16) and rear surface (18), as well as an edge surface (20). The said anchor (10) comprises a rear tubular portion (22), as seen in FIGS. 8 and 9, that protrudes rearward from the said rear surface (18) of the base member 14) and a front tubular portion (24) that protrudes frontward from the said front surface (16) of the said base member (14). The front tubular portion (24) may be structured such that it has a seating surface (25) that can engage a hydraulic jack tensioner (not shown) during the tensioning of a tendon (34).

As seen in FIG. 6, the base member (14) is square in shape having a thickness (t) to facilitate uniform distribution of load on concrete surface and the said base member (14) is chamfered at the corners to rounded shape to minimize stress concentration. The extension of the base member (14) creates a bearing surface (26) on the rear surface (18) of the base member (14) as seen in FIGS. 8 and 9. The anchor (10) includes a surface (28) on the front of the anchor (10), opposite the bearing surface (26) on the rear surface (18), which extends from the front tubular portion (24) in lateral and transverse directions.

Referring to FIG. 8, the anchor (10) for post tensioned concrete reinforcement comprises a tubular section (30) that extends through the base member (14) perpendicular to both the front (16) and rear surface (18) of the base member (14), formed due to the front tubular portion (24) and rear tubular portion (22) having a common axis. As seen in FIG. 8, the inner cavity of the said tubular section (30) tapers linearly with maximum inner diameter (D) being at the farthest plane parallel to front surface (16) on the front tubular portion (22) and minimum inner diameter (d) being at the farthest plane parallel to the rear surface (18) on the rear tubular portion (24), so as to facilitate receiving of a conventional tapered wedge (32). The said tapered wedge (32) cams against inner surface of the tubular portion (30) and clamps down on a tendon (34) that extends through the tubular portion (30). The tendon (34) enters the he tubular portion (30) through the rear tubular portion (22) of the anchor (10) and exits through the front tubular portion (24). The height of the said tubular section (30) is at least as great as that of the said conventional tapered wedge (32) and the minimum diameter (d) of the tubular section is at least as great as that of diameter of the sheathing on the tendon (34) to be anchored.

Figure 7:
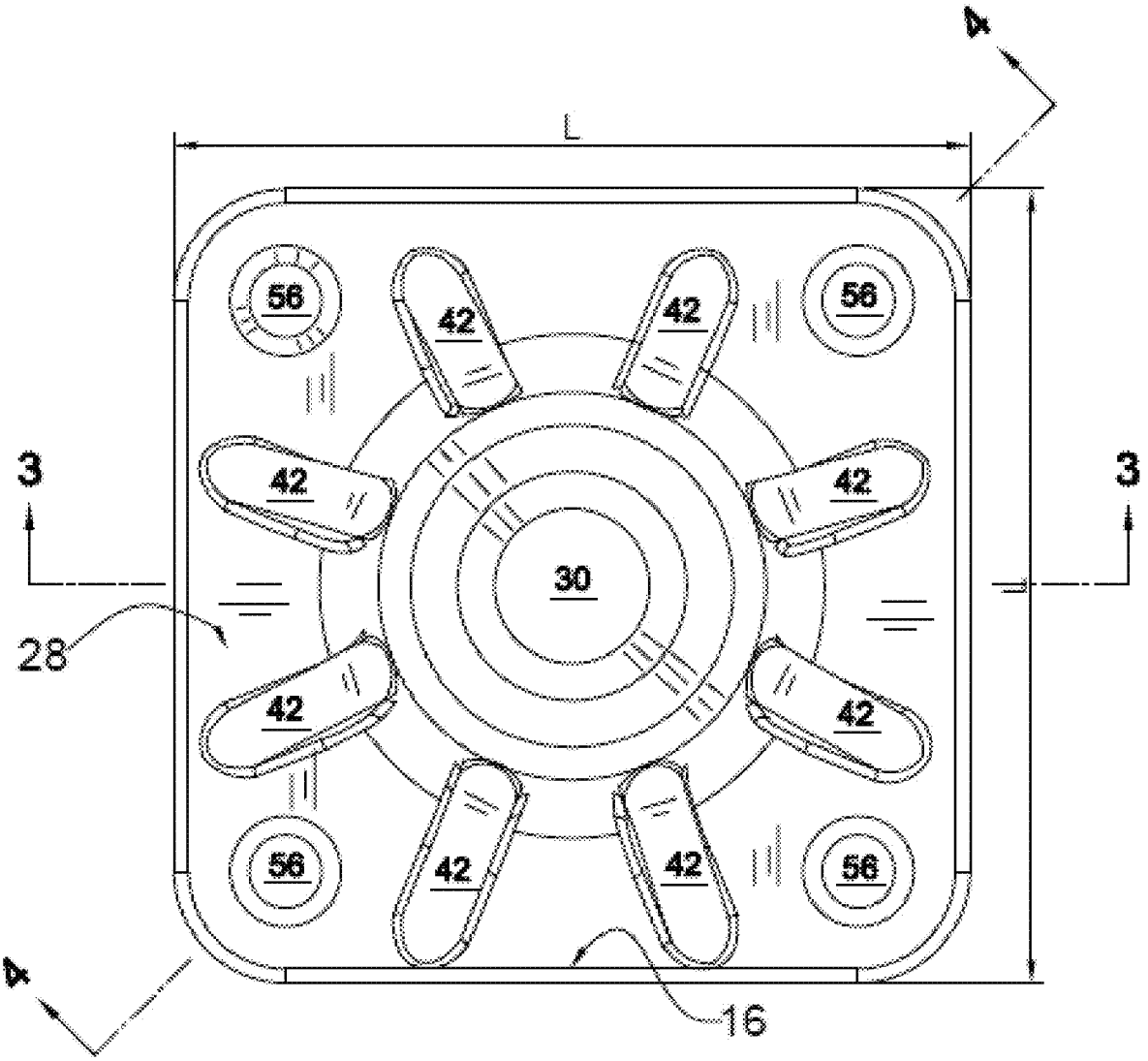
FIG. 7 is a top elevation view thereof.

The anchor (10) for post tensioned concrete reinforcement comprises reinforcing ribs (42) that extend radially outward from an exterior of the front tubular portion (24) on the said front surface (16) to facilitate the transfer of the load uniformly in all direction on concrete through base member (14). As seen in FIGS. 6 and 7, the anchor (10) comprises eight ribs (42) i.e., double the numbers of ribs than prior arts (in prior arts only four ribs constructed). Total eight ribs uniformly constructed at equal distance to each other of square shaped base member (14). The ribs (42) may converge toward the front tubular portion (24) and their imaginary inward extension converge to a point on the axis of the said front tubular portion (24) that is spaced forward of the planar surface (28) and end near sides (20). As the eight ribs are constructed at equal distance to each other also may help to make barrel stronger and distribute uniform tensile load on bearing plate and thus on concrete surface. The eight reinforcing ribs (42) are constructed in such a way that it also helps to increase overall strength per unit square area of the base member (14) of the anchor (10).

The thickness of the base member (14) (forming the bearing surface (26)) may be reduced to 0.21 inches (5.33 mm) or less. It has been determined that the thickness of the base member (14) may be reduced as compared to the prior art structure from 0.23 inches (5.84 mm). When other dimensions are changed according to the invention, without substantially reducing the strength of the anchor (10). An advantage offered by reducing the thickness of the base member (14) is reduced overall weight of the anchor (10). As a result of the reduced raw material used in producing the square concrete anchor, the weight of each anchor (10) is reduced, which in turn results in savings in material and shipping costs. Importantly, these advantages are gained while maintaining structural integrity of the anchor.

The anchor (10) for post tensioned concrete reinforcement comprises four mounting holes (56) as seen in FIGS. 6 and 7, double than prior art. In prior arts only two holes are provided. Notably these mounting holes are not placed on the ribs (42) in order to avoid any loss of reinforcing strength of the ribs (42). The mounting holes (56) are located closer to corner of base member (14) of the anchor (10) for post tensioned concrete reinforcement as shown in FIG. 8. The mounting holes (56) provides clearance for nails (58), or other fasteners, to mount the anchor 10 to the concrete slab (not shown), or if the nails (58) are driven in the opposite direction through the holes 56, into a form board (not shown). Moreover, an anchor 10 may be free of any mounting holes (56) altogether and may be attached to the concrete slab or form board by other means. The advantage offered by four holes (56) in the base member (14) of the anchor (10) for post tensioned concrete reinforcement is reduced overall weight of the said anchor (10). As a result of the reduced raw material used in producing the square concrete anchor (10), the weight of each anchor (10) for post tensioned concrete reinforcement is reduced, which in turn results in savings in material cost, material handling, storage and shipping costs. Importantly, these advantages are gained while maintaining structural integrity of the anchor. Yet another advantage offered by four holes 56 in the metal structure of the square concrete 10 is more flexibility to mount the base member (10) in any orientation whether horizontal, vertical or diagonal by use of minimum two holes with nails or other fasteners.

The combined effect of the eight reinforcing ribs (42) that extend radially outward and four nails (58) for mounting is that the lateral expansion span of the base member (14) reduces significantly when compared with that of the base plate of conventional anchors for a similar load bearing capacity. This reduced area of the base member (14) along with orientation al flexibility offered by its square shape, increases the ease of packaging, storage and handling, thus contributing to further reduction of shipment and material handling cost.

Referring to FIGS. 7-9, The following example dimensions are for industry standard anchor used with 0.500 inch (12.70 MM/12.90 MM) nominal outer diameter (OD) tendons (the OD being defined as without a sheath on the tendon). For anchor used with other size tendons, the dimensions shown in the example of FIGS. 7-9 are typically directly, appropriately scaled with respect to the nominal diameter of the tendon.

The anchor (10) for post tensioned concrete reinforcement may be formed from metal. Such as cast steel or ductile iron, by sand casting. As the accuracy of sand casting is limited, not all Surfaces or dimensions will be exact. Thus, when this description defines, refers to, or characterizes a Surface, edge, or component using a descriptive term including, but not limited to, parallel, collinear, or planar, such a relationship is fulfilled when it is as close to that condition as the casting method provides under normal operating conditions.

Figure 11:
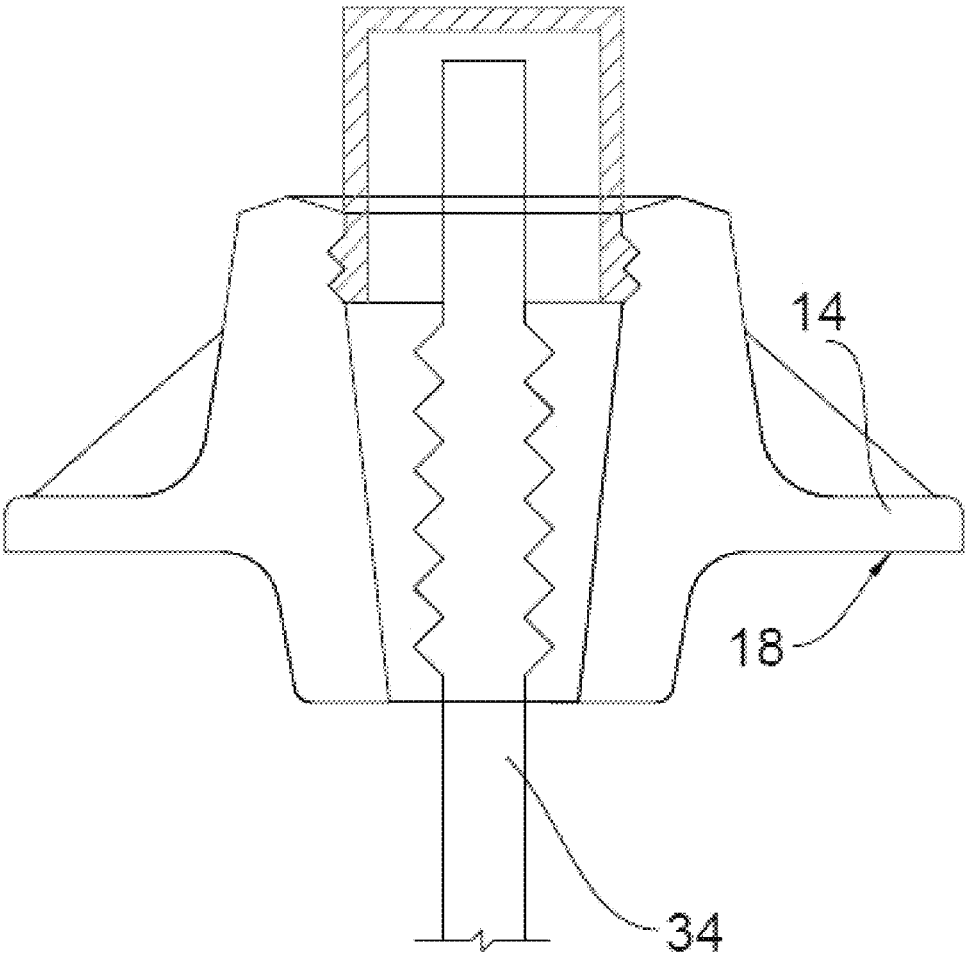
FIG. 11 shows another embodiment of an anchor for post tensioned concrete reinforcement having grease cap attached to threaded anchor.
Figure 12:
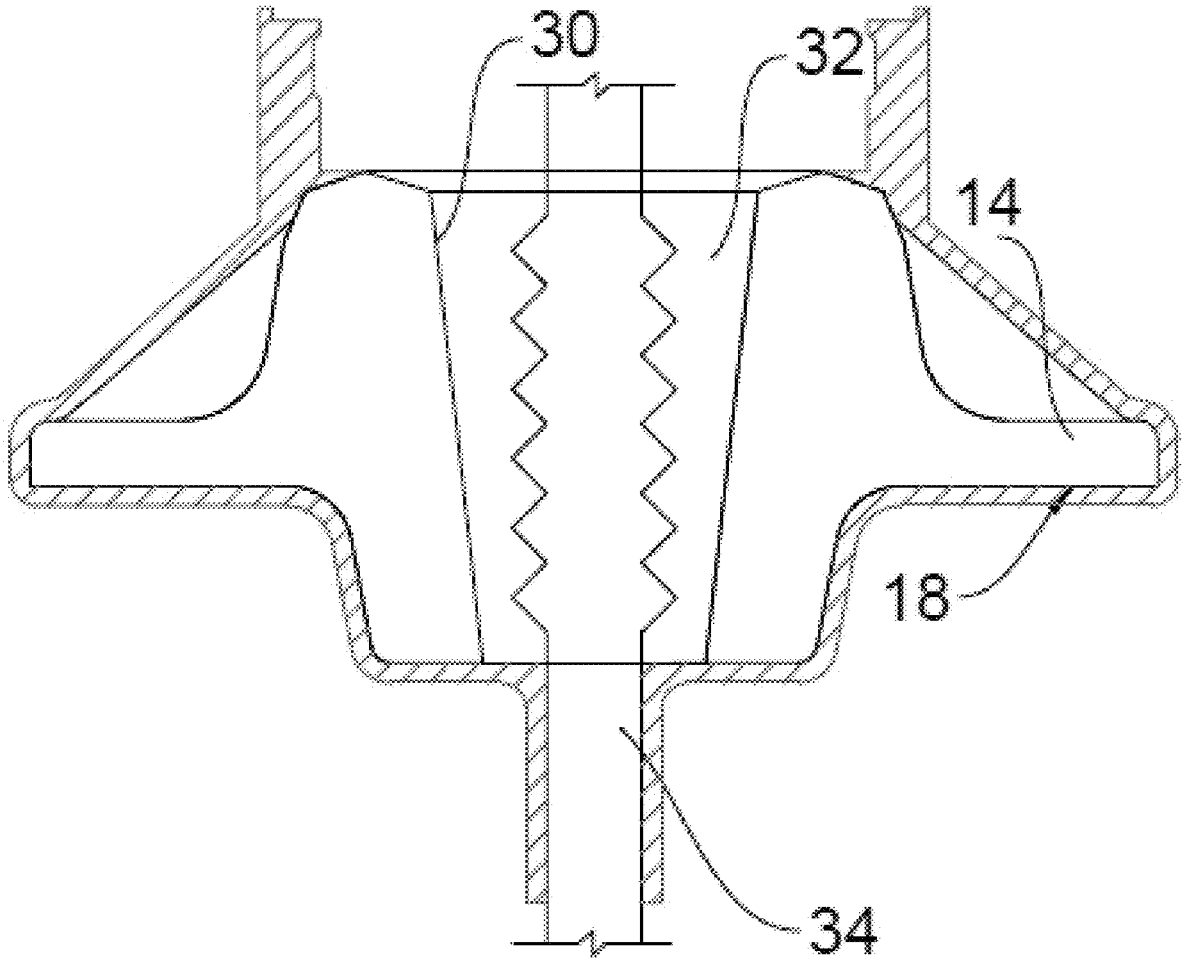
FIG. 12 shows another embodiment of an anchor for post tensioned concrete reinforcement as per present invention with plastic encapsulation to prevent any corrosion.

FIG. 11 shows another embodiment of the anchor (10) for post tensioned concrete reinforcement which includes attachment arrangement for Grease cap. The anchor is extended with specific threading in inner side of the mouth so that grease cap can be attached to it after stressing and cutting excess length of the post-tensioned cable. Grease cap protects the anchor assembly (anchor, wedges and cable) from atmospheric actions such as corrosion. FIG. 12 shows one more embodiment of the anchor (10) for post tensioned concrete reinforcement with polymer encapsulation. The base member (14) is covered by sheathing layer made up of an HDPE or PE (plastic) such that it covers the anchor (10) plate and protects from corrosion.

Figure 13:
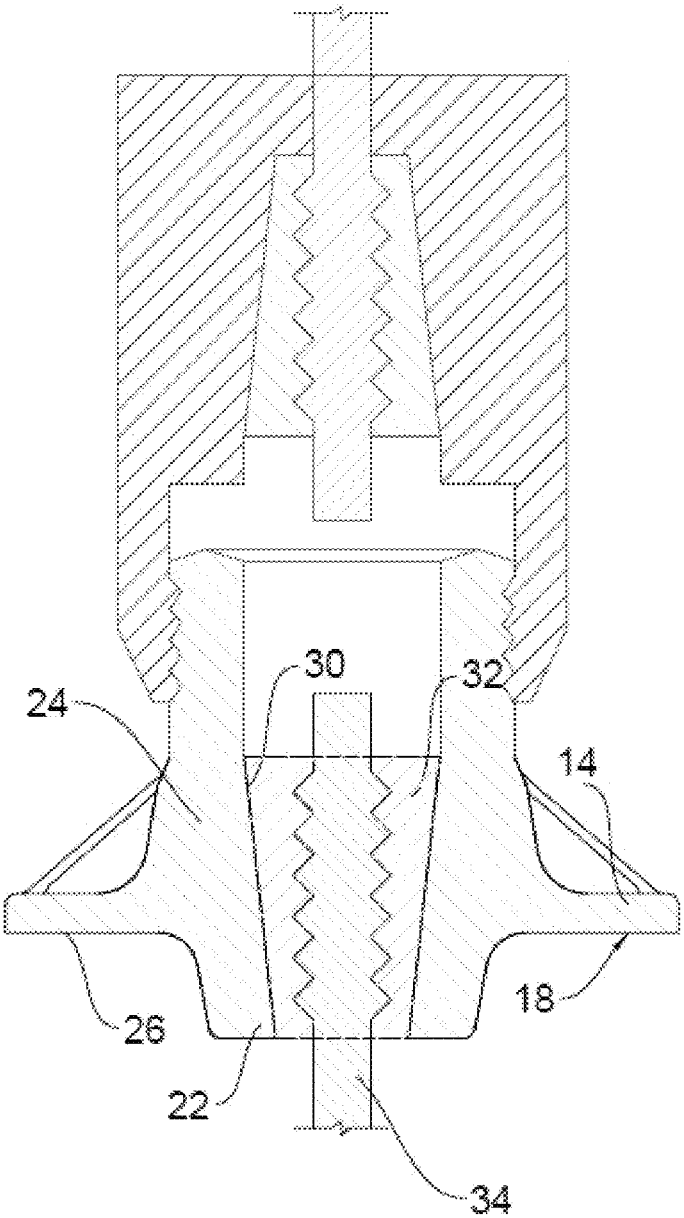
FIG. 13 shows another embodiment of an anchor for post tensioned concrete reinforcement as per present invention with connection details to be deployed as an intermediate anchor.

FIG. 13 shows one more embodiment of the anchor (10) for post tensioned concrete reinforcement with arrangement to extend the cable end. This detail is to provide a provision of extending the cable length for future extension. This also provides flexibility to cast each pour segments one-after another to accommodate the limitation of volume of concrete casting in one go. A new cable of next pour can be joined to adjacent old pour junction just by attaching a coupling device to the existing anchor (10) plate through a specific threading as shown in the embodiment. This arrangement allows the anchor of the present invention to be deployed as an intermediate anchor.

The anchor of the present invention can be used in a variety of applications, such as bridges, buildings, and other structures. The anchor is lightweight and compact, making it easy to install. It is also corrosion-resistant, which provides increased durability. The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

The invention claimed is:

1. An anchor (10) for post tensioned concrete reinforcement comprising:

a base member (14) shaped substantially as a square plate having a thickness (t) to facilitate uniform distribution of a load on a concrete surface and said base member being chamfered at the corners to a rounded shape to minimize stress concentration;

said base member (14) having a front surface (16), a rear surface (18), and an edge surface (20) extending between the front surface and the rear surface;

a rear tubular portion (22) protruding rearwardly from the rear surface (18) of said base member (14); and a front tubular portion (24) protruding frontwardly from the front surface (16) of said base member (14):

wherein the front tubular portion (24) and rear tubular portion (22) have a common axis thereby forming a through tubular section (30) perpendicular to both the front surface (16) and rear surface (18) of said base member (14) such that an inner cavity of said through tubular section (30) tapers linearly with a maximum inner diameter (D) being at a farthest plane parallel to front surface (16) on the front tubular portion (24) and a minimum inner diameter (D) being at a farthest plane parallel to the rear surface (18) on the rear tubular portion (22), to facilitate receiving of a conventional tapered wedge (32);

wherein the height of said through tubular section (30) is at least as great as that of said conventional tapered wedge (32) and the minimum diameter (D) of the through tubular section is at least as great as that of a diameter of the sheathing on a tendon (34) to be anchored;

reinforcing ribs (42) extending radially outward from an exterior of the front tubular portion (24) on said front surface (16) to facilitate the transfer of the load uniformly in all direction on the concrete through said base member (14);

four mounting holes (56) near each of four corners of said square plate shaped base member to secure said base member via nails (58) through said holes perpendicular to the front and rear surface to allow flexibility of spatial orientation of the anchor and to reduce the specific weight carried by each nail in turn reducing the lateral expansion and thickness of base member;

wherein the said tapered wedge (32) cams against the inner cavity of the said through tubular section (30) to clamp down on the tendon (34) that extends into the inner cavity of said through tubular section (30) from the opening in a rearward protrusion direction where the diameter of the tapered cavity of the through tubular section (30) is at a minimum;

wherein the number of such radially extending reinforcing ribs (42) is eight for uniform distribution of forces, and each reinforcing rib is uniformly constructed and spaced at an equal distance to each other, and wherein the ribs converge toward said front tubular portion (24) and each of their imaginary inward extensions converge to a point on the axis of said front tubular portion (24) that is spaced forward of a planar surface (28) and the edge surface.

2. The anchor (10) for post tensioned concrete reinforcement as claimed in claim 1, wherein the thickness of said base member is from 0.21 to 0.24 inches.

3. The anchor (10) for post tensioned concrete reinforcement as claimed in claim 1, wherein the flexibility of spatial orientation of said anchor specifically includes horizontal, vertical or diagonal orientation of said base member (14).

4. The anchor (10) for post tensioned concrete reinforcement as claimed in claim 1, wherein said anchor (10) further comprises a grease cap that prevents any atmospheric effects on tapered wedges (32) and cable/tendon (34) inside said through tubular section (30).

5. The anchor (10) for post tensioned concrete reinforcement as claimed in claim 1, wherein a sheathing layer made up of HDPE or PE, provides protection against corrosion to the metal body of said anchor (10).

6. The anchor (10) for post tensioned concrete reinforcement as claimed in claim 1, wherein said anchor (10) can be arranged to provide flexibility to be deployed as an intermediate anchor.

* * * * *